US008654356B2

(12) United States Patent
Maekawa et al.

(10) Patent No.: US 8,654,356 B2
(45) Date of Patent: Feb. 18, 2014

(54) PRINTER COVER OPENING/CLOSING MECHANISM, AND PRINTER

(75) Inventors: Hironori Maekawa, Suwa (JP); Masahiko Yamada, Omi-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/453,148

(22) Filed: Apr. 23, 2012

(65) Prior Publication Data

US 2013/0107281 A1 May 2, 2013

(30) Foreign Application Priority Data

Nov. 2, 2011 (JP) ..... 2011-240926

(51) Int. Cl.
*G06F 3/12* (2006.01)

(52) U.S. Cl.
USPC ..... 358/1.1

(58) Field of Classification Search
None
See application file for complete search history.

(56) References Cited

U.S. PATENT DOCUMENTS

| | | | | |
|---|---|---|---|---|
| 6,462,839 | B1 * | 10/2002 | Short | 358/474 |
| 6,629,796 | B2 * | 10/2003 | Kawakami et al. | 400/582 |
| 6,758,614 | B2 * | 7/2004 | Yamada et al. | 400/58 |
| 6,914,688 | B2 * | 7/2005 | Inana | 358/1.12 |
| 7,309,179 | B2 * | 12/2007 | Toran et al. | 400/648 |
| 8,066,368 | B2 | 11/2011 | Maekawa et al. | |

FOREIGN PATENT DOCUMENTS

JP 2009-101652 A 5/2009

* cited by examiner

*Primary Examiner* — Jeremiah Bryar
(74) *Attorney, Agent, or Firm* — Nutter McClennen & Fish LLP; John J. Penny, Jr.; Michael P. Visconti, III

(57) ABSTRACT

Characterized by having a printer cover that is attached to a main unit and opens and closes; a contact member that contacts or separates from an installation surface according to the state of the printer relative to an installation surface on which the printer is placed; and a preventing member that does not prevent the opening or closing operation of the printer cover when the contact member contacts the installation surface, and prevents the opening or closing operation of the printer cover when the contact member separates from the installation surface.

8 Claims, 8 Drawing Sheets

PRINTER COVER OPENING/CLOSING MECHANISM, AND PRINTER

TECHNICAL FIELD

The present invention relates to a printer cover opening/closing mechanism capable of preventing the opening or closing operation of a printer cover, which is attached to a printer so that the cover can open and close, according to the installation position and posture of the printer, and to a printer having this opening/closing mechanism.

RELATED ART

Printers generally have a printer cover that can open and close so that ink cartridges, roll paper, and other consumables can be replaced and the inside can be accessed for maintenance. For example, roll paper printers have a printer cover that is opened and closed to replace the roll paper attached to the opening of the roll paper storage compartment. The printer cover is, for example, disposed to the front of the printer so that the cover can pivot on the bottom end part of the printer cover to open and close between an upright closed position and an open position to which it drops down to the front of the printer, and is locked in the closed position by a lock mechanism. A roll paper printer thus configured is described in Patent Document 1.

PRIOR ART DOCUMENTS

Patent Documents

Patent Document 1: Japanese Unexamined Patent Appl. Pub. JP-A-2009-101652

SUMMARY OF INVENTION

Problem to be Solved by Invention

However, if this roll paper printer or other printer is tilted while the printer cover is open, the printer cover may slam closed. For example, if the printer cover is attached to the front of the printer, and the printer is tilted back, which is the direction in which the printer cover closes, while the printer cover is open, the open printer cover will also be tilted toward the closed position. If the printer is tilted greatly, the moment that is produced by the weight of the printer cover in the opening direction and acts on the printer cover is reduced, or a moment in the closing direction is applied. As a result, the printer cover could slam closed. When the printer cover slams closed, it will hit other parts of the printer and could produce a loud unexpected bang. The printer cover must also be opened again if the printer cover closes unexpectedly.

The printer cover is also normally locked in the closed position by a lock mechanism, and when the lock is disengaged, the printer cover is unstable and can move easily in the opening/closing direction. Therefore, if the printer is tilted or the printer is picked up when the printer cover lock is disengaged, the printer cover can swing greatly in the opening/closing direction, and this is inconvenient.

With consideration for the foregoing problem, an object of the present invention is to provide a mechanism for opening and closing a printer cover that can prevent the printer cover from moving forcefully when the printer is tilted or picked up, and a printer having this opening/closing mechanism.

Means for Solving the Problem

To solve the foregoing problem, a printer cover opening/closing mechanism according to the invention is characterized by having: a printer cover that is attached to a main unit and opens and closes; a contact member that contacts or separates from an installation surface according to the state of the printer relative to an installation surface on which the printer is placed; and a preventing member that does not prevent the opening or closing operation of the printer cover when the contact member contacts the installation surface, and prevents the opening or closing operation of the printer cover when the contact member separates from the installation surface.

A printer according to the invention is characterized by having: a main unit having a recording unit that records an image on a recording medium and a storage unit that stores the recording medium, and contacts an installation surface with a support part; a printer cover that is attached to a main unit and opens and closes; a contact member that contacts or separates from the installation surface according to the state of the installation surface to the support part; and a preventing member that does not prevent the opening or closing operation of the printer cover when the contact member contacts the installation surface, and prevents the opening or closing operation of the printer cover when the contact member separates from the installation surface.

When the contact member is in contact with the installation surface on which the printer is placed, the printer cover can open and close without being stopped by the preventing member, and when the contact member separates from the installation surface, the opening or closing operation of the printer cover is stopped by the preventing member. The contact member can be set to separate from the installation surface when the position of the printer relative to the printer installation surface is, for example, tilted at least a specific angle to the installation surface. In this case, the contact member separates from the installation surface when the printer is tilted, and in conjunction therewith the opening or closing operation of the printer cover is prevented by the preventing member. The printer cover can therefore be prevented from moving unintentionally in the opening direction or the closing direction when the printer is tilted. Furthermore, if the contact member is configured to separate from the installation surface when the printer is lifted at least a specific height from the installation surface, the printer cover can be stopped from swinging in the opening/closing direction by the preventing member when the printer is picked up while the printer cover is open, and the printer can be prevented from becoming unstable due to the open printer cover swinging in the opening/closing direction.

The printer according to the invention can also be configured so that the contact member contacts the installation surface when the support part of the main unit contacts the installation surface, and the contact member separates from the installation surface when at least part of the support part separates a specific amount from the installation surface.

When the printer is placed correctly on the installation surface, the support part contacts the installation surface, and when the printer is tilted to the installation surface or rises up (is picked up), for example, at least part of the support part separates from the installation surface. The printer cover can therefore be prevented from moving unexpectedly in the opening direction or closing direction when the printer is tilted. Furthermore, because the printer cover is prevented from swinging in the opening/closing direction by the preventing member when the printer is lifted and moved while the printer cover is open, the printer can be prevented from becoming unstable due to the open printer cover swinging in the opening/closing direction.

The printer according to the invention may also have an urging member that urges the contact member in the direction contacting the installation surface. The contact member can be prevented by the urging member from unexpectedly changing to the position separated from the installation surface.

The printer of the invention may also have a rocking lever that swings on a pivot axis, has the preventing member disposed thereto at a different position than the pivot axis, and is configured so that the rocking lever swings according to operation of the contact member and moves the preventing member. The linkage mechanism between the contact member and the preventing member can be rendered with a small, compact, simple configuration that does not require much installation space using a single rocking lever.

The preventing member in the printer of the invention can be a member that stops the printer cover from closing when the printer cover is open. This configuration can prevent the printer cover from slamming closed and can prevent unstable states with the printer cover swinging in the opening/closing direction when the printer is tilted or picked up while the printer cover is open.

The support part in the printer according to the invention may have a first leg part disposed on the printer cover side, and a second leg part disposed to a position separated further from the printer cover than the first leg part, so that the contact member separates from the installation surface when the first leg part separates from the installation surface. When the printer is tilted relative to the installation surface to a position where the first leg part separates from the installation surface, this configuration prevents the opening or closing operation of the printer cover and can prevent the printer cover from slamming open or closed.

The printer of the invention could also have a cover urging member that urges the printer cover in the closing direction. The urging force of the cover urging member can prevent the printer cover from opening forcefully while also enabling closing the printer cover easily with little strength.

DESCRIPTION OF EMBODIMENTS

A preferred embodiment of a printer with the printer cover opening/closing mechanism according to the invention is described below with reference to the accompanying figures.

General Configuration of the Printer

Figure 1:
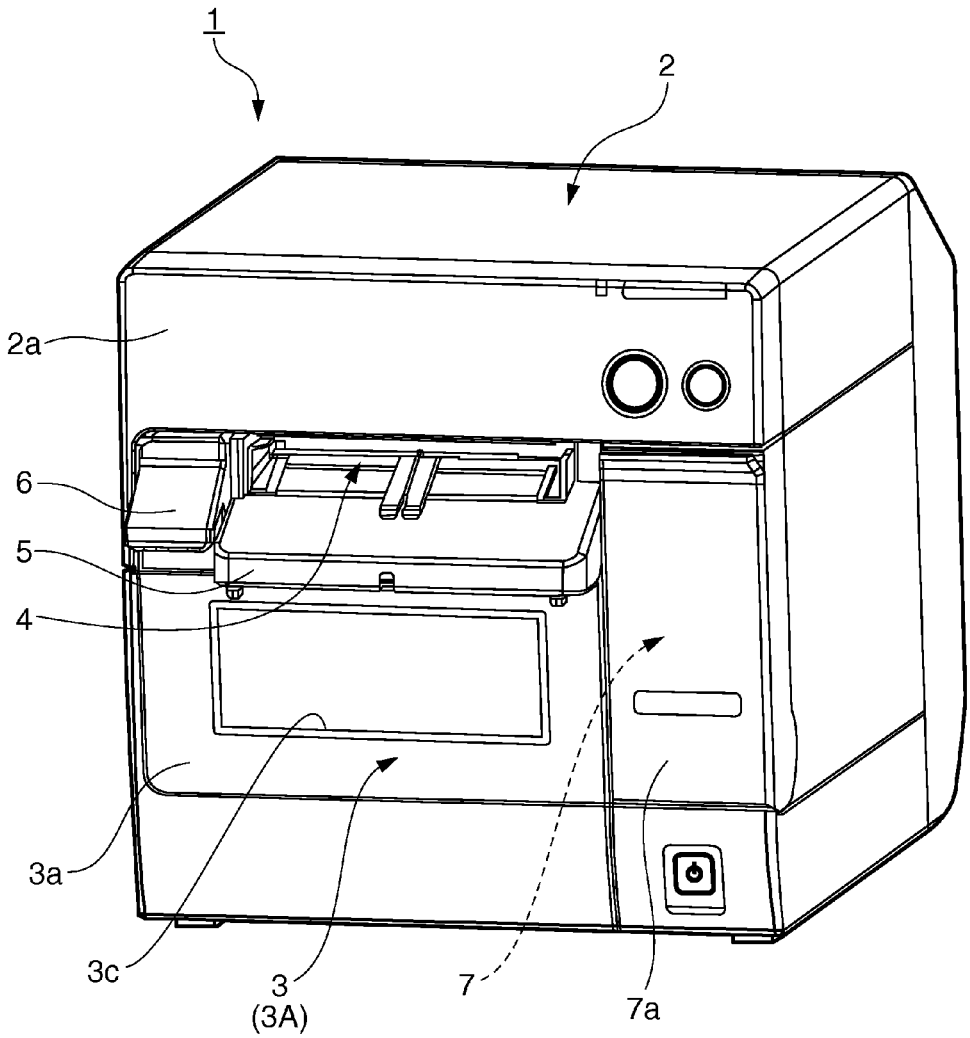
FIG. 1 is an oblique view of a roll paper printer according to the invention.
Figure 2:
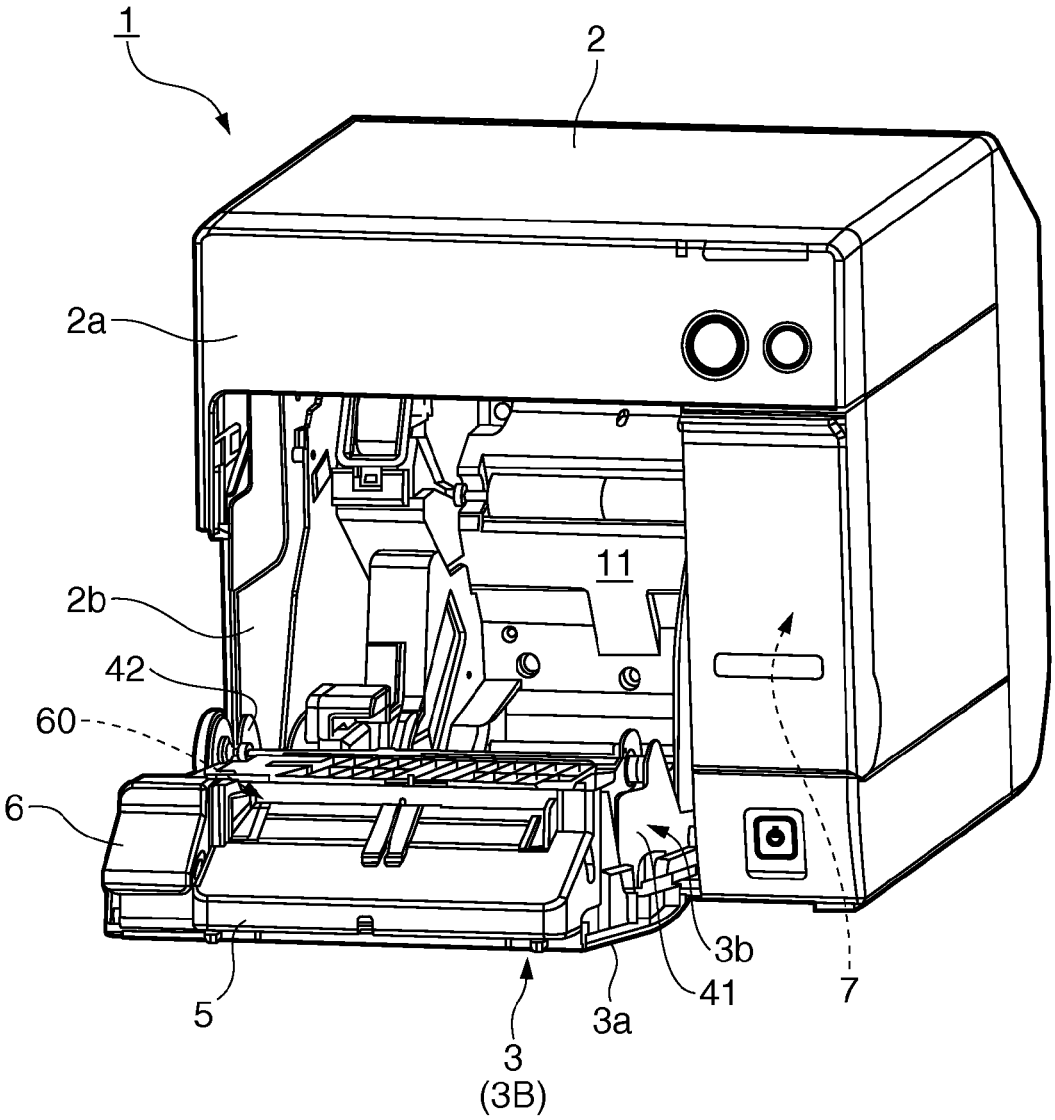
FIG. 2 is an oblique view of the roll paper printer with the printer cover open.

FIG. 1 is an external oblique view of an inkjet roll paper printer according to this embodiment of the invention, and FIG. 2 is an external oblique view of the roll paper printer with the printer cover open. As shown in the figures, the roll paper printer 1 has a basically rectangular box-shaped printer unit 2 (main unit), and a printer cover 3 attached to the front of the printer unit 2. A recording paper exit 4 of a specific width is formed in the front of the outside case 2*a* of the printer unit 2. A paper exit guide 5 projects to the front below the recording paper exit 4, and a cover opening lever 6 is disposed beside the paper exit guide 5. A rectangular opening 2*b* for loading and removing roll paper is formed below the paper exit guide 5 and cover opening lever 6 (the front side of the printer), and this opening 2*b* is closed by the printer cover 3. A cover 7*a* that covers the opening to the ink cartridge or ink tank storage unit 7 is disposed beside the printer cover 3 at the front of the printer unit 2.

Operating the cover opening lever 6 unlocks the lock mechanism that locks the printer cover 3 in the closed position. A mechanism known from the literature can be used for the lock mechanism, and further description thereof is omitted here and in the figures. When the paper exit guide 5 is pulled forward after releasing the lock, the printer cover 3 pivots on the bottom end thereof and opens forward to a substantially horizontal position by means of the opening/closing mechanism 3*b* (see FIG. 4) attached to the back side of the cover case 3*a*, which forms the front part of the printer cover 3. When the printer cover 3 opens from the vertical closed position 3A shown in FIG. 1 to the substantially horizontal open position 3B (fully open position) to which it drops to the front of the printer as shown in FIG. 2, the roll paper compartment 11 formed inside the printer is open, the recording paper conveyance path from the roll paper compartment 11 to the recording paper exit 4 is also open, and the roll paper can be easily replaced from the printer front. When the printer cover 3 is in the open position 3B, the printer cover 3 is held in the open position 3B by a position control member not shown.

Printer Support Unit

Figure 3:
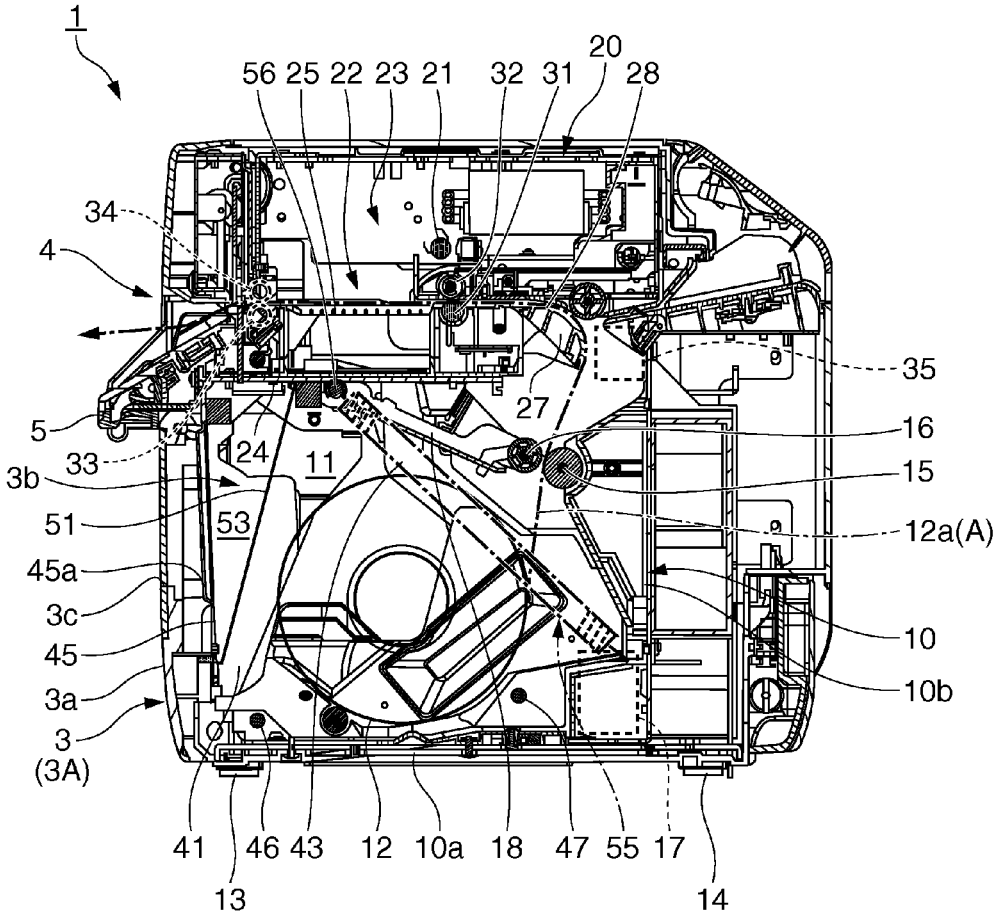
FIG. 3 is a vertical section view of the roll paper printer.
Figure 4:
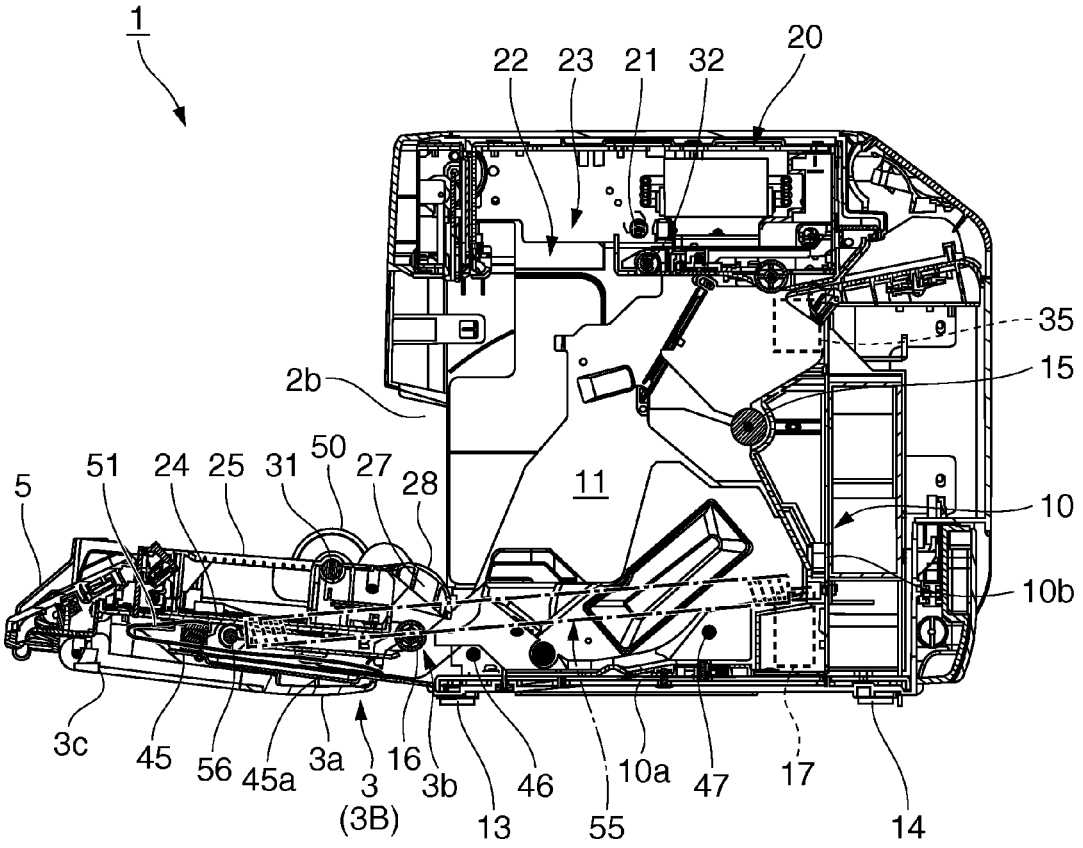
FIG. 4 is a vertical section view of the roll paper printer with the printer cover open.

FIG. 3 is a vertical section view showing the internal construction of the roll paper printer 1, and FIG. 4 is a vertical section view with the printer cover 3 in the open position 3B. Parts disposed inside the roll paper printer 1 are assembled to a printer unit frame 10 made from sheet metal or other rigid material. A support unit for the printer unit 2 is attached to the bottom 10*a* of the printer unit frame 10. The support unit in this embodiment includes a pair of first legs 13 located at opposite sides of the printer width at the front end of the printer, and a pair of second legs 14 located at opposite sides of the printer width at the back end of the printer. When the roll paper printer 1 is placed on the installation surface G (see FIG. 6 to FIG. 8), the front and back first and second legs 13, 14 are touching the installation surface G.

Internal Structure of the Printer

The internal structure of the roll paper printer 1 is described next with reference to FIG. 3 and FIG. 4. A roll paper compartment 11 (recording medium storage unit) is formed inside the roll paper printer 1. Roll paper 12 (recording medium) is stored so that it can roll on its side facing the printer width inside the roll paper compartment 11. A supply roller 15 is disposed at the top back part of the roll paper compartment 11, and the supply roller 15 is supported horizontally between the sides of the printer width by the printer unit frame 10. A pressure roller 16 is pressed from the front to the supply roller 15. The supply roller 15 is driven rotationally by a paper feed motor 17 attached to the printer unit frame 10. The pressure roller 16 is supported by a support lever 18 attached on the printer cover 3 side, and when the printer cover 3 opens, the pressure roller 16 separates from the supply roller 15.

A head unit frame 20 is attached horizontally to the top of the printer unit frame 10 above the roll paper compartment 11.

A carriage guide shaft 21 extends horizontally widthwise to the printer on the head unit frame 20. A carriage 23 can move reciprocally widthwise to the printer along this carriage guide shaft 21. An inkjet head 22 (recording unit) is mounted facing down on the carriage 23. The carriage 23 is moved reciprocally widthwise to the printer by a carriage conveyance mechanism known from the literature, such as a carriage conveyance mechanism having a carriage motor and timing belt.

A platen frame 24 that extends horizontally in the front-back direction of the printer is disposed below the inkjet head 22. A suction platen 25 is disposed to the platen frame 24 horizontally widthwise to the printer with a specific gap to the inkjet head 22, and this suction platen 25 determines the printing position of the inkjet head 22.

A tension guide 27, around which travels the web of recording paper 12*a* pulled from the roll paper 12 stored in the roll paper compartment 11, is disposed at the back end of the platen frame 24. The tension guide 27 can pivot vertically on a support shaft that extends horizontally widthwise to the printer at the back end of the platen frame 24. A torsion spring or other urging member is attached to the support shaft, and the convex recording paper guide surface 28 of the tension guide 27 is urged to the recording paper 12*a* side by this urging member.

A paper feed roller 31 extends horizontally widthwise to the printer at a position on the platen frame 24 on the front side of the tension guide 27. A pressure roller 32 attached to the head unit frame 20 side is pressed from above with specific pressure to the paper feed roller 31 with the recording paper 12*a* therebetween. A front paper feed roller 33 extends horizontally widthwise to the printer at a position on the platen frame 24 at the front end of the suction platen 25. A front pressure roller 34 attached to the head unit frame 20 side is pressed from above to the front paper feed roller 33 with the recording paper 12*a* therebetween.

The paper feed roller 31 and front paper feed roller 33 are driven by a paper feed motor 35 attached to the printer unit frame 10 at the back side of the roll paper compartment 11. In this embodiment a speed reducer gear train not shown is mounted on the platen frame 24, and torque from the paper feed motor 35 is transferred through this speed reducer gear train to the paper feed roller 31 and front paper feed roller 33, and the paper feed roller 31 and front paper feed roller 33 rotate synchronously.

The recording paper 12*a* pulled from the roll paper 12 stored in the roll paper compartment 11 is conveyed through the conveyance path A indicated by the bold dot-dash line in FIG. 3. This conveyance path A travels up between the supply roller 15 and pressure roller 16, curves to the front around the tension guide 27, and passes between the paper feed roller 31 and pressure roller 32, the inkjet head 22 and suction platen 25, and the front paper feed roller 33 and front pressure roller 34 to the recording paper exit 4. The tension guide 27 is pushed down by the recording paper 12*a* loaded in the conveyance path A, and urging force from the tension guide 27 side keeps a specific amount of tension applied to the recording paper 12*a*.

Printer Cover Opening/Closing Mechanism

Figure 5:
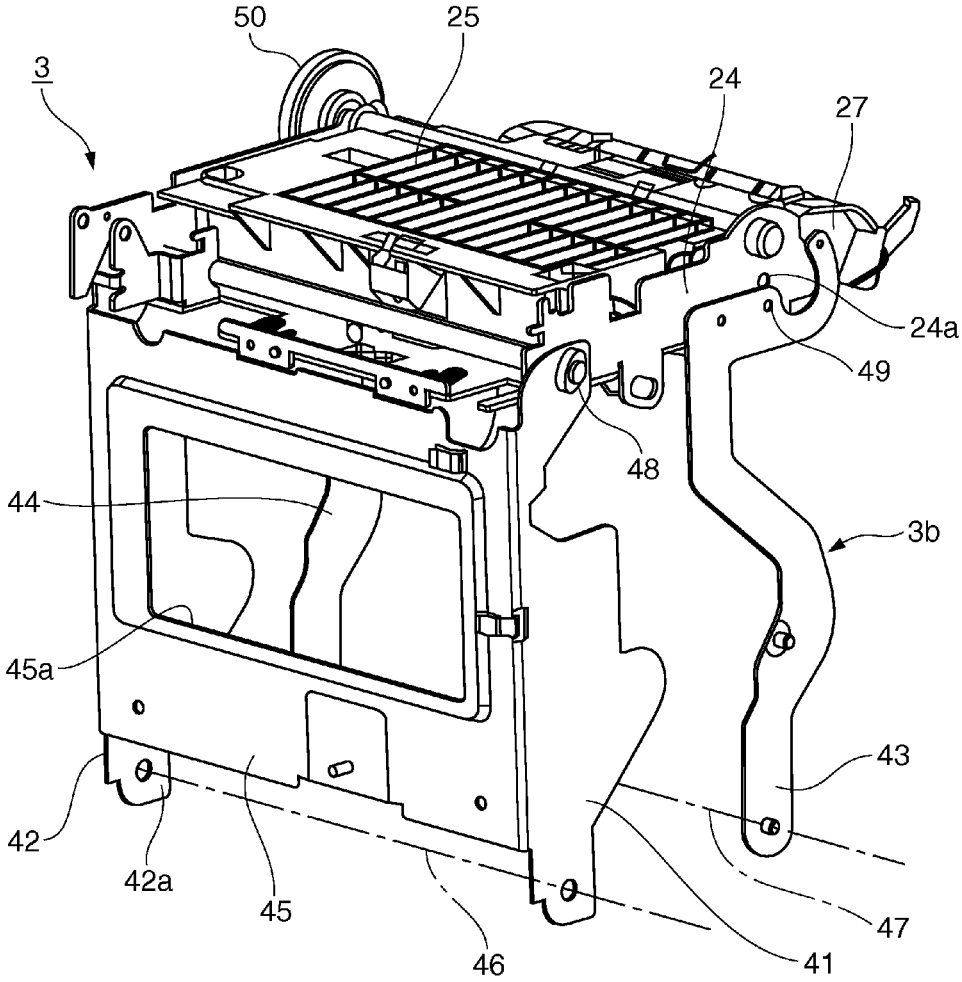
FIG. 5 is an oblique view of the printer cover opening/closing mechanism.

FIG. 5 shows the opening/closing mechanism 3*b* of the printer cover 3, and is an oblique view from diagonally in front of the left side of the printer. Note that the cover case 3*a* of the printer cover 3 is not shown in this figure. As will be understood from this figure, the opening/closing mechanism 3*b* of the printer cover 3 is supported on the printer unit 2 so that it can open and close to the printer front by means of a four-joint parallel linkage mechanism. This parallel linkage mechanism has a pair of left and right front parallel links 41, 42 (first links) attached to the cover case 3*a*, and a pair of left and right rear parallel links 43, 44 (second links). The bottom end parts of the front parallel links 41, 42 are supported freely pivotably front and back on pivot pins 46 at the bottom 10*a* of the printer unit frame 10 (see FIG. 3, FIG. 4), and the rear parallel links 43, 44 are also supported by the bottom 10*a* freely pivotably front and back on pivot pins 47.

The front parallel links 41, 42 are connected together by the front frame panel 45 in which a window 45*a* for checking how much roll paper remains is formed. A window 3*c* is also formed in the cover case 3*a* at a position overlapping the window 45*a* (see FIG. 1). The roll paper 12 stored in the roll paper compartment 11 can be checked from the outside through window 3*c* and window 45*a* when the printer cover 3 is in the closed position.

The top end parts of the front parallel links 41, 42 are connected freely rotatably on pivot pins 48 to the front end part of the platen frame 24. The top ends of the rear parallel links 43, 44 and the back end part of the platen frame 24 are connected to allow only a specific amount of movement vertically therebetween. An oval hole 24*a* that is long vertically is formed in the platen frame 24 side, and pivot pins 49 attached to the top ends of the rear parallel links 43, 44 are inserted rotatably and slidably in the holes 24*a*.

A guide roller 50 is attached freely rotatably to the platen frame 24 in the side on the right side of the platen frame 24. When the printer cover 3 is in the closed position 3A, this guide roller 50 rests on top of an inclined surface not shown formed on the printer unit frame 10 side. As a result, the platen frame 24 is held substantially horizontal, and the suction platen 25 attached thereto is held in the printing position opposite the nozzle surface of the inkjet head 22 with a specific gap therebetween.

When the printer cover 3 opens and closes, the suction platen 25, tension guide 27, paper feed roller 31, and other parts mounted on the platen frame 24 move and open or close therewith. When the printer cover 3 is lowered to the front pivoting on the pivot pins 46 of the front parallel links 41, 42, the platen frame 24 disposed between the front parallel links 41, 42 and rear parallel links 43, 44 also moves forward and down. As a result of this movement, the guide roller 50 of the platen frame 24 slides and drops along the inclined surface not shown of the printer unit frame 10. When the printer cover 3 is in the open position 3B, the front parallel links 41, 42 and rear parallel links 43, 44 fold together substantially horizontally at the side of the platen frame 24.

As shown in FIG. 3 and FIG. 4, a tension spring 55 is connected between the printer cover 3 and the printer unit frame 10, and the printer cover 3 is urged in the closing direction. The front end of the tension spring 55 is mounted on a support pin 56 that supports the support lever 18 of the platen frame 24 so that it can swing front-back, and the back end of the tension spring 55 is mounted on the bottom end part of the back panel portion 10*b* of the printer unit frame 10. When the printer cover 3 is locked in the closed position 3A and the lock is then released, the force of this spring prevents the printer cover 3 from opening due to its weight. In addition, as will be understood from FIG. 4, the tension spring 55 stretches when the printer cover 3 opens, and a strong spring force acts in the closing direction on the printer cover 3 in the open position 3B. The printer cover 3 can therefore be lifted and closed with little force from the open position 3B.

Open/Close Preventing Mechanism

Figure 6:
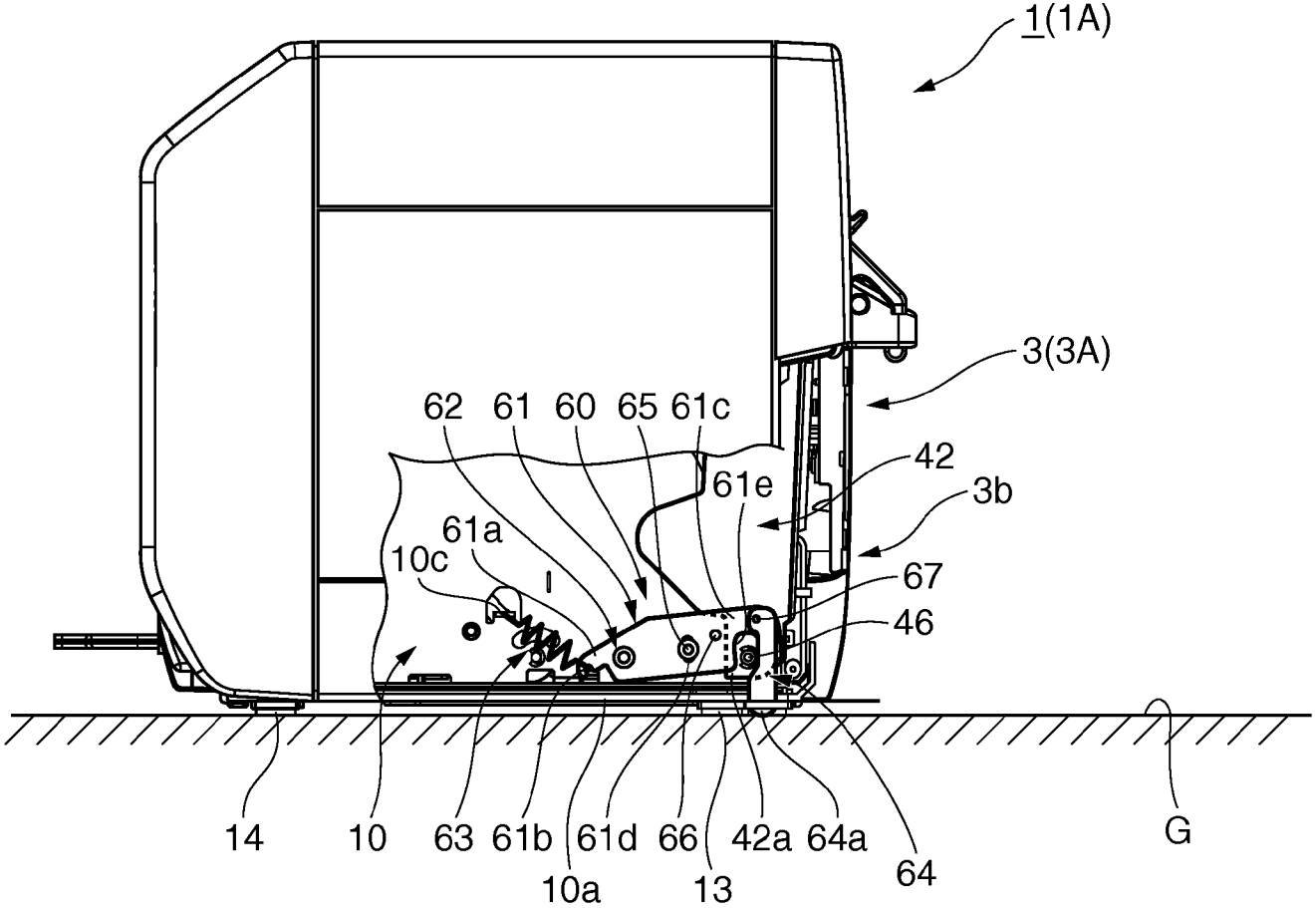
FIG. 6 is a side view of the roll paper printer with the printer cover closed.
Figure 7:
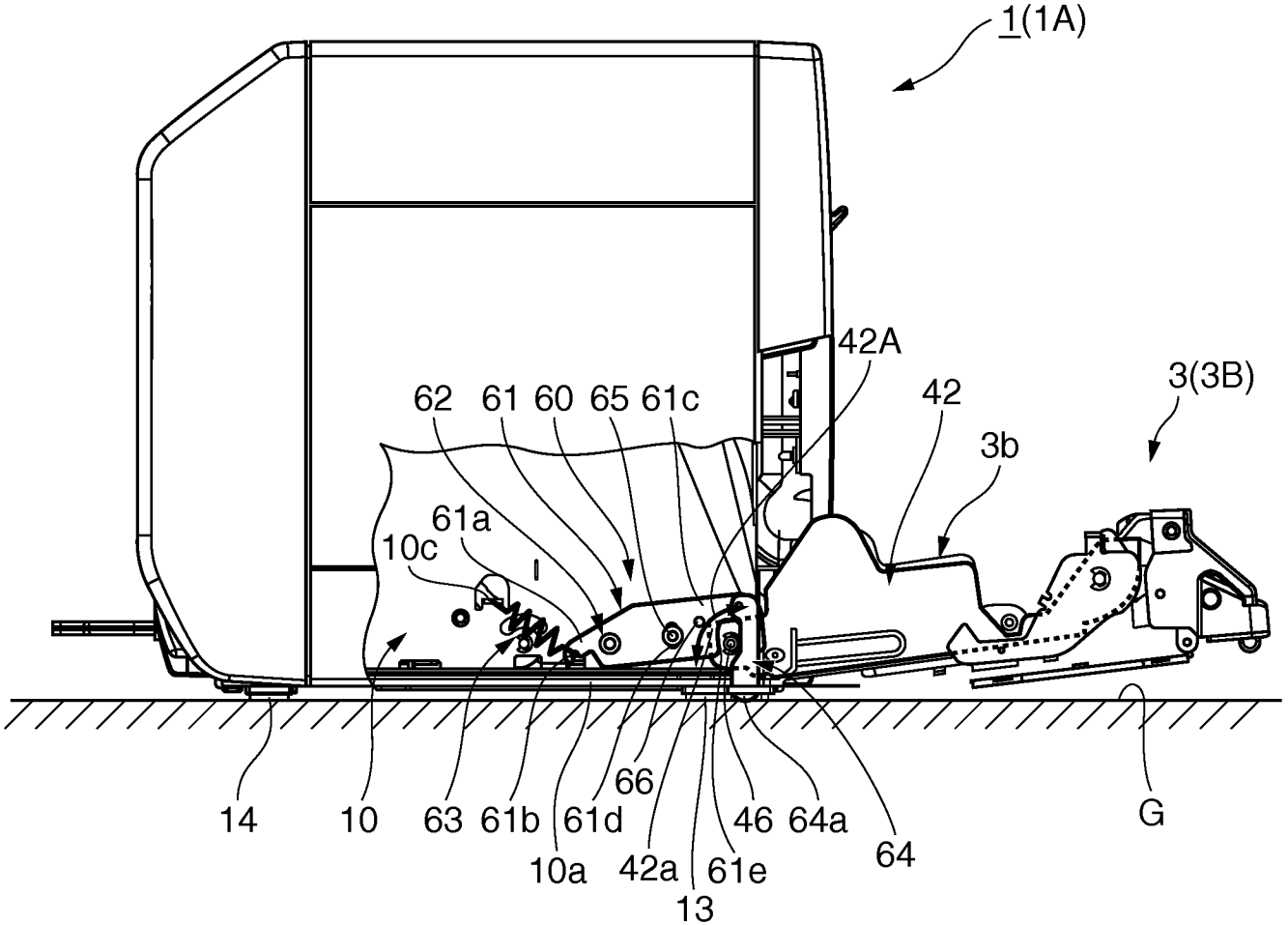
FIG. 7 is a side view of the roll paper printer with the printer cover open.
Figure 8B:
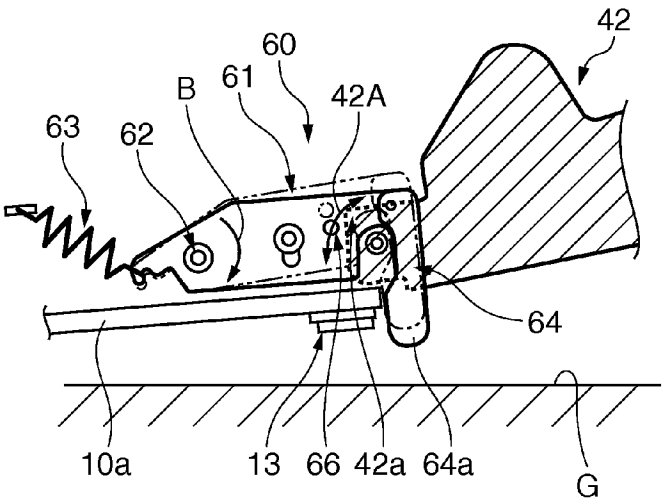
FIGS. 8A and 8B are side views of the roll paper printer when tilted with the printer cover open.
Figure 8A:
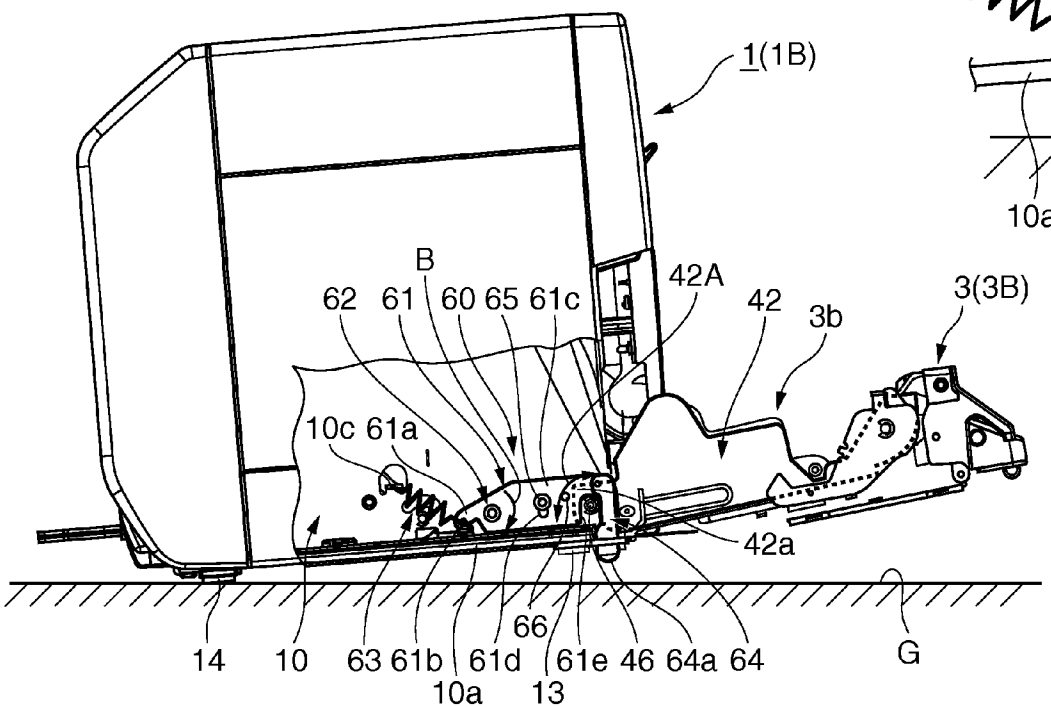

The open/close preventing mechanism that is disposed to the opening/closing mechanism 3*b* of the printer cover 3 and prevents the opening or closing operation of the printer cover 3 is described next with reference to FIG. 6 to FIG. 8. FIG. 6 is a side view of the roll paper printer 1 in the normal operating position with the legs (support parts) of the roll paper printer 1 touching the installation surface. FIG. 7 is a side view of the roll paper printer in the normal operating position from the same side as in FIG. 6 with the printer cover 3 opened to the open position 3B. FIG. 8 (*a*) is a side view of the cover opening lever 6 from the same side as in FIG. 6, and shows the roll paper printer 1 tilted to the back with the printer cover 3 open. More specifically, the first legs 13 on the printer cover 3 side of the roll paper printer 1 are separated from the installation surface. FIG. 8 (*b*) shows the area of the open/close preventing mechanism enlarged. Note also that a portion of the side part of the outside case 2*a* is not shown in FIG. 6, FIG. 7, and FIG. 8 (*a*) in order to show the opening/closing mechanism 3*b* of the printer cover 3 and the open/close preventing mechanism 60.

Referring to FIG. 6, the open/close preventing mechanism 60 has a sheet metal rocking lever 61 that moves to a position in the open/close path and a position outside the open/close path of the printer cover 3 according to the position of the roll paper printer 1 relative to the installation surface G (relative position). The rocking lever 61 is positioned in the front-back direction of the printer along the outside of the front parallel link 42 in the four-joint parallel linkage mechanism in the opening/closing mechanism 3*b* of the printer cover 3. This rocking lever 61 is supported by the printer unit frame 10 so that it can rock vertically to the printer on a pivot pin 62 attached horizontally to the printer unit frame 10. The pivot pin 62 is disposed to a position on the back side of the pivot pins 46 defining the open/close axis of the printer cover 3.

A spring catch 61*b* is formed at the end of the rear lever portion 61*a* of the rocking lever 61 extending toward the back of the printer from the pivot pin 62. A spring catch 10*c* formed on the printer unit frame 10 is disposed to a position above and to the back of the printer from the spring catch 61*b*. A tension spring 63 that urges the lever is mounted between these spring catches 61*b*, 10*c*. The front lever portion 61*c* of the rocking lever 61 extending toward the front of the printer from the pivot pin 62 is constantly urged down by the spring force of the tension spring 63.

The top end of a contact member 64 that protrudes toward the printer bottom is attached to the end of the front lever portion 61*c* of the rocking lever 61. The top end of the contact member 64 is connected to the rocking lever 61 pivotably on a horizontal pin 67 that is fixed to the rocking lever 61. The bottom end 64*a* of the contact member 64 protrudes below through a hole formed in the bottom 10*a* of the printer unit frame 10. A guide hole 61*d* and a guide channel 61*e* extending in the rocking direction of the rocking lever 61 are formed in the front lever portion 61*c* at a position between the pivot pin 62 and contact member 64. A guide pin 65 attached horizontally on the printer unit frame 10 side is inserted through the guide hole 61*d*. The pivot pin 46, which determines the open/close axis of the printer cover 3, is slidably inserted to the guide channel 61*e* from the open bottom side. These parts guide the rocking action of the rocking lever 61 and determine the range of rocking lever 61 movement.

As shown in FIG. 6 and FIG. 7, when the roll paper printer 1 is placed on an installation surface G such as a horizontal table, the front and back pairs of first legs 13 and second legs 14 on the bottom of the roll paper printer 1 touch the installation surface G, and the roll paper printer 1 is in the normal upright position 1A with the top-bottom axis of the printer upright relative to the installation surface G. When in this normal upright position 1A, the contact member 64 of the rocking lever 61 that protrudes below the first legs 13 of the bottom 10*a* is pushed up a specific amount by the installation surface G as will be understood from FIG. 7. The rocking lever 61 therefore goes to a tilted position with the front thereof rotated slightly towards the printer top.

However, as shown in FIG. 8, if the front of the roll paper printer 1 is lifted up at an angle pivoting on the second legs 14 at the back of the roll paper printer 1 in the normal upright position 1A, the first legs 13 at the front (the front of the roll paper printer 1) rise up and away from the installation surface G. In conjunction therewith, the contact member 64, which is urged down by the force of the spring, maintains the same state as when in contact with the installation surface G while the amount protruding below the printer increases, and the rocking lever 61 swings in the direction of arrow B. When the front first legs 13 of the roll paper printer 1 separate (are lifted) a specific distance from the installation surface G, the contact member 64 separates vertically from the installation surface G, and the protrusion of the bottom end 64*a* of the contact member 64 protruding down from the bottom 10*a* reaches the maximum protrusion. More specifically, the bottom end 64*a* of the contact member 64 protrudes the greatest amount below the first legs 13.

A cover engagement pin 66 that protrudes horizontally widthwise to the printer is fixed to a part of the rocking lever 61 between the guide hole 61*d* and guide channel 61*e*. The cover engagement pin 66 is located to the back of the printer relative to the bottom end of the front parallel link 42 of the printer cover 3. The cover engagement pin 66 moves to a position in the open/close path or outside the open/close path of the front parallel link 42 of the printer cover 3 according to the position of the rocking lever 61.

The open/close path 42A of the corner 42*a* on the back side of the bottom of the front parallel link 42 traces a curve centered on the pivot pins 46, which define the pivot point of the open/close action, in conjunction with the printer cover 3 opening or closing. As shown in FIG. 7, the cover engagement pin 66 is located to the back of the printer from the open/close path 42A when the contact member 64 is pushed up by the installation surface G (when in contact with the installation surface G). When the front part of the roll paper printer 1 is raised from the installation surface G, the rocking lever 61 rocks due to the spring force. As a result, the cover engagement pin 66 moves to a position inside the open/close path 42A as shown in FIG. 8. Because the corner 42*a* of the front parallel link 42 attempting to move in the closing direction from the open position 3B contacts the cover engagement pin 66 that has moved to this position, movement of the printer cover 3 in the closing direction is prevented and the printer cover 3 remains in the open position 3B. More specifically, the cover engagement pin 66 functions as a stop that restricts the opening or closing operation of the printer cover 3.

How the open/close preventing mechanism 60 thus configured prevents the printer cover 3 from opening or closing is described next. When the roll paper printer 1 is in the normal upright position 1A shown in FIG. 6 and FIG. 7, the contact member 64 of the rocking lever 61 is pushed up by the installation surface G (the contact member 64 is in contact with the installation surface G), and the cover engagement pin 66 is positioned to the back of the printer from the open/close path 42A, that is, in the position not restricting the opening or closing operation of the printer cover 3. The printer cover 3 can therefore be closed from the open position 3B without interference from the cover engagement pin 66. In addition, because the printer cover 3 is constantly pulled in the closing direction by the tension spring 55 (see FIG. 4), the printer cover 3 can be closed easily with little effort. Because the printer cover 3 is locked in the closed position 3A by the locking mechanism not shown when the printer cover 3 is closed, the printer cover 3 will not open accidentally.

When the roll paper printer 1 is then tilted back while the printer cover 3 is open as shown in FIG. 8, the front bottom part of the roll paper printer 1 rises from the installation surface G. As a result, the first legs 13 that were in contact with the installation surface G separate from the installation surface G, and the rocking lever 61 is released from being pushed up by the installation surface G and swings down due to the spring force. This causes the cover engagement pin 66 of the rocking lever 61 to move to a position inside the open/close path 42A on the printer cover 3 side. Because the printer cover 3 therefore contacts the cover engagement pin 66 if the printer cover 3 attempts to close in this closed position 1B, the printer cover 3 is held in the open position 3B.

More specifically, when the roll paper printer 1 is tilted back as shown in FIG. 8, or in other words is tilted in the direction separating the first legs 13 at the printer front from the installation surface G, the roll paper printer 1 tilts in the closing direction of the printer cover 3. Because the moment in the opening direction produced by the weight of the printer cover 3 decreases in this case, the spring force of the tension spring 55 may cause the printer cover 3 to close unexpectedly. If the printer cover 3 closes with force, the printer cover 3 striking the edge or other parts of the opening to the roll paper compartment 11 may produce a loud unexpected bang upon impact. When the roll paper printer 1 is tilted in the closing direction of the printer cover 3 in this embodiment, the rocking lever 61 swings as described above and the cover engagement pin 66 interferes with the closing operation of the printer cover 3. This problem can therefore be avoided because the printer cover 3 is held in the open position.

The contact member 64 of the rocking lever 61 is located below the pivot axis of the opening or closing action of the printer cover 3. Therefore, when the first legs 13 at the front of the roll paper printer 1 are lifted even slightly (when the roll paper printer 1 is tilted even slightly), the rocking lever 61 swings reliably and the cover engagement pin 66 moves to the position where it interferes with movement of the open printer cover 3. Movement of the printer cover 3 can therefore be prevented reliably and quickly when the roll paper printer 1 is tilted to an angle at which there is a danger of the printer cover 3 slamming closed.

The open/close preventing mechanism 60 also operates when the entire roll paper printer 1 is lifted a specific amount from the installation surface G. More specifically, the rocking lever 61 swings and the cover engagement pin 66 moves to the inside of the path of movement when the printer cover 3 opens and closes. As a result, the opening or closing operation of the printer cover 3 is prevented and the printer cover 3 will not open and close unexpectedly. More particularly, the roll paper printer 1 will be unstable if the printer cover 3 swings in the open/close direction when the roll paper printer 1 is picked up and moved while the printer cover 3 is open. Because the printer cover 3 is held in the open position 3B in this embodiment of the invention, the roll paper printer 1 can be prevented from becoming unstable and difficult to handle because of the printer cover 3 swinging.

Other Embodiments

The rocking lever 61 swings when the roll paper printer 1 is tilted with the open/close preventing mechanism 60 described above. A sliding lever that can slide up and down can be used instead of this rocking lever 61. In this case an urging force such as a spring force simply pushes the sliding lever down.

The spring force of the tension spring 63 is used in the embodiment described above to urge the rocking lever 61. Alternatively, or in conjunction therewith, the weight of the 61 could be used to move the rocking lever 61. For example, if a weight is attached to the front lever portion 61*c* side of the rocking lever 61, the rocking lever 61 will swing of its own weight when the roll paper printer 1 is raised, and the contact member 64 will protrude down as shown in FIG. 8.

The embodiment described above causes a rocking lever 61 to swing so that a cover engagement pin 66 can engage the front parallel link 42 of the opening/closing mechanism 3*b* of the printer cover 3. Alternatively, the cover engagement pin 66 can obviously be configured to engage another part of the opening/closing mechanism 3*b* of the printer cover 3 instead.

The embodiment described above also has a contact member 64 and a cover engagement pin 66 as a preventing member attached to the rocking lever 61. Alternatively, movement of the contact member 64 could be transferred through a linkage mechanism other than the rocking lever 61 to a preventing member other than the cover engagement pin 66, and this preventing member could stop the opening or closing operation of the printer cover 3. A configuration combining a contact part that functions as a contact member and a stop that functions as a preventing member in a single member is also conceivable.

The foregoing embodiment describes having the open/close preventing mechanism 60 disposed to the opening/closing mechanism 3*b* of the printer cover 3 for opening or closing the roll paper compartment 11 of a roll paper printer 1. The invention can also be adapted to printer covers for opening or closing parts other than the opening to a roll paper compartment.

A case in which the first legs 13 of the roll paper printer 1 separate from the installation surface G when the roll paper printer 1 is tilted is described above, but the invention can also be used with configurations in which the bottom 10*a* (base) contacts the installation surface G directly. In this case, the contact member 64 separates from the installation surface G when at least part of the bottom 10*a* on the printer cover 3 side separates from the installation surface G.

The invention claimed is:

1. A printer cover opening/closing mechanism comprising:

a printer cover that is attached to a main unit of a printer and opens and closes;

a contact member that contacts or separates from an installation surface according to a state of the printer relative to an installation surface on which the printer is placed; and a preventing member that does not prevent the opening or closing operation of the printer cover when the contact member contacts the installation surface, and prevents the opening or closing operation of the printer cover when the contact member separates from the installation surface.

2. A printer comprising:

a main unit having a printing unit that prints an image on a recording medium and a storage unit that stores the recording medium, and contacts an installation surface with a support part;

a printer cover that is attached to the main unit and opens and closes;

a contact member that contacts or separates from the installation surface according to a position of the support part relative to the installation surface; and a preventing member that does not prevent the opening or closing operation of the printer cover when the contact member contacts the installation surface, and prevents the opening or closing operation of the printer cover when the contact member separates from the installation surface.

3. The printer described in claim 2, wherein:

the contact member contacts the installation surface when the support part of the main unit contacts the installation surface; and the contact member separates from the installation surface when at least part of the support part separates a specific amount from the installation surface.

4. The printer described in claim 2, further comprising:

an urging member that urges the contact member in a direction contacting the installation surface.

5. The printer described in claim 2, further comprising:

a rocking lever that swings on a pivot axis, and has the preventing member disposed thereto at a different position than the pivot axis;

wherein the rocking lever swings according to operation of the contact member and moves the preventing member.

6. The printer described in claim 2, wherein:

the preventing member is a member that stops the printer cover from closing when the printer cover is open.

7. The printer described in claim 2, wherein:

the support part has a first leg part disposed on a printer cover side of the main unit, and a second leg part disposed to a position separated further from the printer cover than the first leg part; and the contact member separates from the installation surface when the first leg part separates from the installation surface.

8. The printer described in claim 2, further comprising:

a cover urging member that urges the printer cover in the closing direction.

* * * * *